United States Patent [19]

Maures et al.

[11] Patent Number: 4,705,655

[45] Date of Patent: Nov. 10, 1987

[54] PROCESS FOR THE MANUFACTURE OF COMBUSTIBLE ARTICLES BY EMBOSSING COMBUSTIBLE PAPER AND COMBUSTIBLE ARTICLES THUS PRODUCED

[75] Inventors: Michel Maures; Jacques Pasdeloup; Patrick Lespinasse, all of Bergerac, France

[73] Assignee: Societe Nationale des Poudres et Explosifs, Paris, France

[21] Appl. No.: 776,430

[22] Filed: Sep. 16, 1985

[30] Foreign Application Priority Data

Sep. 24, 1984 [FR] France ..... 84 14587

[51] Int. Cl.[4] ..... C06B 21/00; F42B 5/18; D03D 23/00; D03D 43/00

[52] U.S. Cl. ..... 264/3.4; 86/1.1; 86/20.1; 102/431; 102/432; 102/700; 149/2; 149/94; 149/96; 149/109.6; 162/226; 264/3.1; 264/293

[58] Field of Search ..... 102/431, 432, 433, 700; 149/9, 12, 14, 2, 94, 96, 109.6; 86/12, 20.1, 1.1; 156/184, 188, 187, 211, 212, 219; 162/219, 117, 226; 264/293, 3.4, 3.1; 101/3 R

[56] References Cited

U.S. PATENT DOCUMENTS

| | | | |
|---|---|---|---|
| 21,253 | 8/1858 | Gomez et al. | 102/431 |
| 2,405,104 | 7/1946 | Mydans | 102/97 |
| 3,939,681 | 2/1976 | Yoshitomi et al. | 72/56 |
| 4,068,589 | 1/1978 | Oversohl | 102/431 |
| 4,119,036 | 10/1978 | Hayashi et al. | 102/374 |
| 4,178,207 | 12/1979 | Oversohl | 162/384 |

FOREIGN PATENT DOCUMENTS

| | | |
|---|---|---|
| 211645 | 10/1960 | Austria . |
| 2038557 | 3/1969 | France . |
| 2404566 | 4/1969 | France . |
| 2234113 | 2/1975 | France . |
| 2461567 | 3/1981 | France . |
| 2485182 | 12/1981 | France . |
| 92414 | 12/1918 | Switzerland . |

*Primary Examiner*—Stephen J. Lechert, Jr.
*Assistant Examiner*—Howard J. Locker
*Attorney, Agent, or Firm*—Bucknam and Archer

[57] ABSTRACT

Process for the manufacture of combustible articles by embossing combustible paper and combustible articles thus produced.

The invention relates to a process for the manufacture of combustible dish-shaped articles of revolution with circular external outlines from combustible paper containing nitrocellulose by embossing at least one combustible paper disc 11 comprising a central part 12 and a peripheral part consisting of a plurality of portions 13 separated from each other by radial slits 14 the length "L" of which is smaller than the radius "R" of the said disc 11 and the width "e" in which is at least equal to the minimum width required to prevent the overlapping of the said portions 13 when the disc 11 is deformed by embossing.

The invention also relates to combustible dish-shaped articles of revolution with circular external out-lines, consisting of at least one sheet of combustible paper containing nitrocellulose and in particular those produced by the process according to the invention.

These articles have their essential application as components for combustible cases and especially as combustible bottoms or as combustible lids.

8 Claims, 9 Drawing Figures

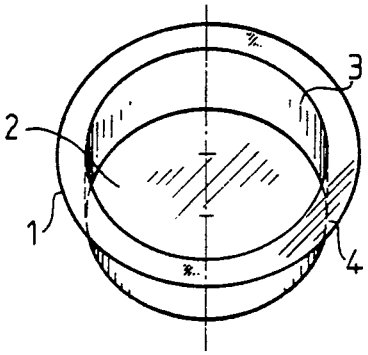
FIG-1
FIG-2
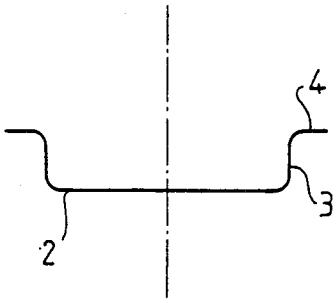
FIG-3
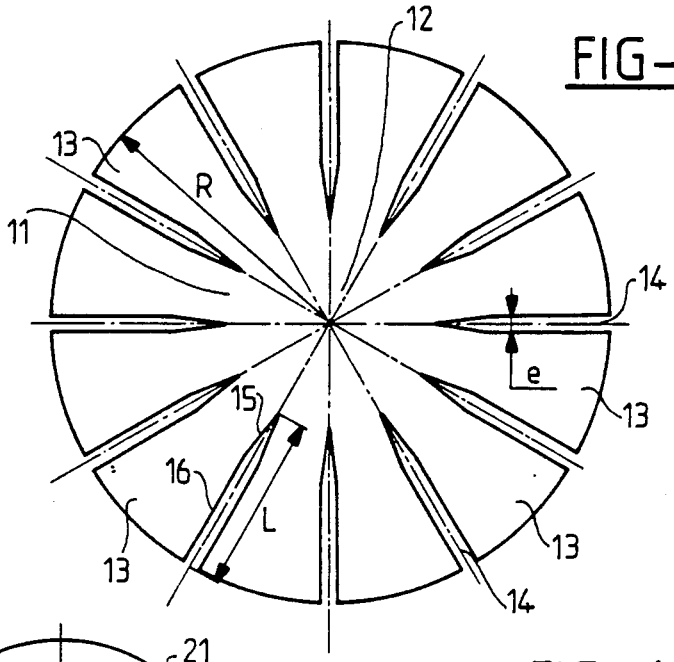
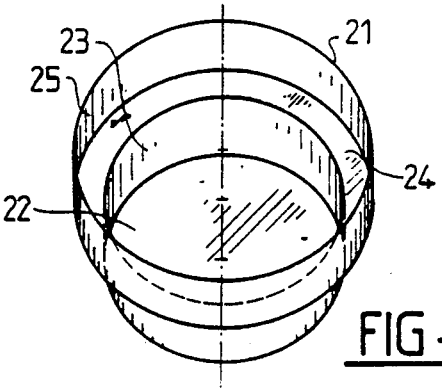
FIG-4
FIG-4a
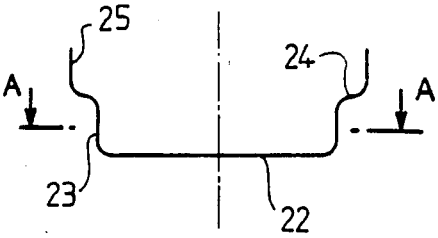

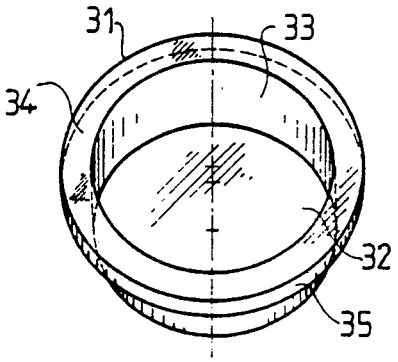
FIG-5
FIG-5a
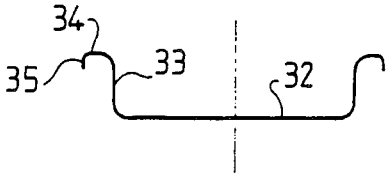
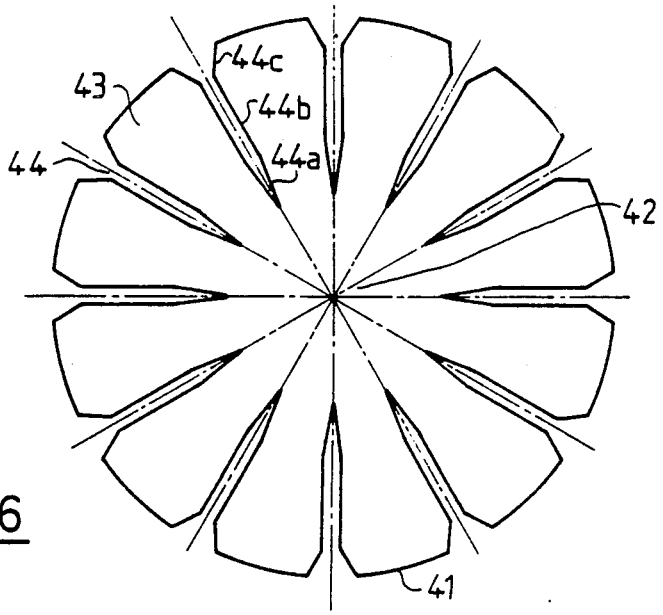
FIG_6
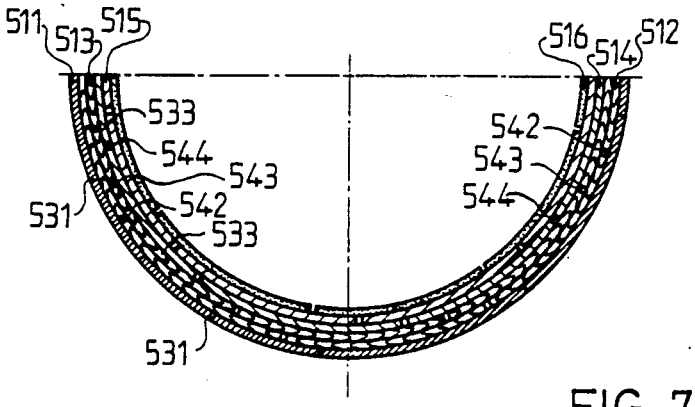
FIG_7

PROCESS FOR THE MANUFACTURE OF COMBUSTIBLE ARTICLES BY EMBOSSING COMBUSTIBLE PAPER AND COMBUSTIBLE ARTICLES THUS PRODUCED

The present invention relates essentially to the field of combustible ammunition and in particular to that of combustible artillery ammunition.

More precisely, the invention relates to a process for the manufacture, from combustible paper containing nitrocellulose, of combustible dish-shaped articles of revolution with circular external outlines and especially a process for the manufacture of parts for combustible cases such as lids, bottoms or combustible containers. The invention also relates, as new industrial products, to combustible articles dish-shaped of revolution with circular external outlines, consisting of sheets of combustible paper containing nitrocellulose.

The armament industry seeks to replace, particularly in the field of artillery, traditional ammunition in which the cases are made of copper or a copper-based alloy, by ammunition, known as combustible ammunition, in which the cases consist of a combustible material which burns at the same time as the propellant powder charge, thus contributing additional energy to the projectile and eliminating the problems connected with the extraction of an empty metal case after firing.

Within the scope of the present invention, the term "case" should be taken with a wide acceptance denoting both a single cylindrical or conical case at the end of which the shell is fixed, and a modular container, generally cylindrical, intended to be placed in the weapon independently of the shell to form a part of the propellant charge, which is determined as a function of the type of firing to be carried out.

A major technical problem confronting the expert is that of large-scale manufacture of such combustible cases. In point of fact, a combustible case essentially consists, precisely like the traditional metal cases, on the one hand, of a cylindrical or conical case body and, on the other hand, of closure components, such as bottoms or lids, which are generally dish-shaped parts of revolution with circular external outlines. The mass production of combustible case bodies has been solved by spiral winding of glue-coated combustible paper strips, the said combustible paper being itself produced by passing through a papermaking machine an aqueous suspension containing nitrocellulose fibres, fibres of organic, synthetic, plant or inorganic origin, a resin and, optionally, a stabiliser such as 2-nitrodiphenylamine or a centralite. French Patent Application Nos. 2,485,182 and 83/06,393 assigned to Societe Nationale des Poudres et Explosifs describe such manufacture in detail. On the other hand, the large-scale manufacture of closure components for such combustible cases has not yet been solved up till now in a wholly satisfactory manner.

These closure components are generally dish-shaped articles of revolution with circular external outlines. They must have two essential characteristics, namely, on the one hand, have good mechanical strength and, on the other hand, be perfectly combustible so that they burn completely at the same time as the powder charge without leaving incandescent residues or ash. Good combustibility of this type of article is ensured by the presence of nitrocellulose in the material of which they are made. The use of combustible paper containing nitrocellulose has not so far made it possible to produce such articles satisfactorily, the term "paper" denoting, within the scope of the present invention, any material produced by a papermaking technique, whether, strictly speaking, it is a paper in the conventional meaning of the term or a cardboard, as a function of its weight per unit area. In effect, while methods for producing boxes or receptacles by folding paper sheets are known, such as those described, for example, in French Patent No. 2,404,566, on the one hand, these methods enable only articles with rectangular, and not circular, outlines to be produced and, on the other hand, they do not make it possible to produce articles having sufficient mechanical strength to be capable of being employed as components of ammunition. Furthermore, when attempts are made to manufacture articles of revolution with circular outlines by embossing plain combustible paper discs, paper folds and superpositions are produced in the zones where the article is raised, as shown in French Patent No. 2,038,557 in relation to the manufacture of paper filters, which cause the appearance in the article of zones of high density which cannot burn correctly, even when they are made of a paper containing nitrocellulose. To overcome difficulties of this type, French Patent No. 2,461,567 proposes to manufacture articles of revolution with circular outlines by embossing two paper sheets between which is arranged a layer of a soft, easily deformable material. However, this method has two major disadvantages: on the one hand it does not solve the problems connected with the requirement of a combustible nature for the article, insofar as this question is not tackled in the patent and, on the other hand, its application is relatively complex and does not lend itself readily to large-scale manufacture. To manufacture closure components for combustible cases which have both good mechanical strength characteristics and good combustion characteristics, the expert was therefore obliged until now to employ moulding techniques according to which the parts are manufactured by pressing and curing in a mould an aqueous suspension with a composition similar to that employed to produce combustible paper containing nitrocellulose, according to a process similar to that described in French Patent No. 2,234,113 also assigned to the same assignee. While this solution is satisfactory insofar as the quality of the products obtained is concerned, it nevertheless has the major disadvantage of requiring the use of a large number of stationary moulds, and consequently not permitting low-cost manufacture on a large scale.

At the present time, therefore, the expert does not have available a simple, low-cost process for the large-scale manufacture of dish-shaped articles of revolution with circular external outlines, and particularly of combustible closure components for combustible cases or for components of combustible cases.

The purpose of the present invention is precisely to offer such a process to the expert.

The invention consequently relates to a process for the manufacture of combustible dish-shaped articles of revolution with circular external outlines, and particularly of combustible closure components such as combustible lids and bottoms for combustible cases or for components of combustible cases, from combustible paper containing nitrocellulose, characterised in that the said article is produced by embossing at least one combustible paper disc comprising a central part and a peripheral part consisting of a plurality of portions separated from each other by radial slits the length "L" of which is smaller than the radius "R" of the said disc and the width "e" of which is at least equal to the minimum width required to prevent the overlapping of the said portions when the disc is deformed by embossing.

According to a preferred embodiment of the invention, the width "e" of each radial slit is not constant, but varies at each point along the radius on which the said slit is situated.

According to a second preferred embodiment of the invention, the said combustible article is produced by embossing several discs of combustible paper, optionally glue-coated, superposed one above another, and whose sets of radial slits are offset relative to the other sets.

The invention also relates, as new industrial products, to combustible dish-shaped articles of revolution with circular external outlines characterised in that they consist of at least one sheet of combustible paper containing nitrocellulose.

In this respect the invention relates particularly to the combustible articles produced by virtue of the process according to the invention.

A detailed description of the invention is given below with reference to FIGS. 1 to 7:

FIG. 1 shows, in perspective, an article according to the invention,

FIG. 2 shows a diagrammatic section through a plane of symmetry of the article shown in FIG. 1, FIG. 3 shows a combustible paper disc used for the manufacture of the article shown in FIG. 1, FIG. 4 shows, in perspective, another article according to the invention, FIG. 4*a* shows a diagrammatic section through a plane of symmetry of the article shown in FIG. 4, FIG. 5 shows, in perspective, another article according to the invention, FIG. 5*a* shows a diagrammatic section through a plane of symmetry of the article shown in FIG. 5, FIG. 6 shows a combustible paper disc used for the manufacture of the articles shown in FIGS. 4 and 5 and FIG. 7 shows a half-section along AA of the article shown in FIG. 4.

The invention relates, consequently to a process for the manufacture of combustible dish-shaped articles of revolution with circular external outlines. Such an article is shown, for example, in FIGS. 1 and 2, in which there can be recognised a dish-shaped article 1 having a flat bottom 2, a slightly frustoconical circular side wall 3, and an external raised edge in the shape of a circular crown 4. These combustible articles are made of combustible paper containing nitrocellulose and produced by passing through a papermaking machine an aqueous suspension containing nitrocellulose fibres, fibres of organic origin such as kraft fibres, fibres of plant origin, such as sisal, fibres of synthetic origin, such as polyester or acrylic fibres, or fibres of inorganic origin, such as glass fibres, a resin and, optionally, a stabiliser. An article of this type is produced by embossing at least one combustible paper disc 11 as shown in FIG. 3. A disc of this type 11 consists of a central part 12 and a peripheral part formed by a plurality of portions separated from each other by radial slits 14 whose length "L" is smaller than the radius "R" of the disc 11. These slits 14 are, according to a preferred embodiment of the invention, identical, as shown in the figures.

An essential characteristic of the invention lies in the fact that the width "e" of each slit is at least equal to the minimum width required to avoid the overlapping of the said portions 13 over each other when the disc 11 is deformed by embossing. According to a preferred embodiment of the invention, the width "e" of each radial slit 14 is not constant but varies at each point along the radius on which the said slit is situated so as to be at least equal at each point to the minimum width required at this point, taking account of the required shape of the said article, to avoid the overlapping of portions 13 when embossed. If reference is made to FIG. 3 it can be seen that each slit 14 consists of two separated parts: a "V"-shaped part 15 in which the edges of the slit are "receding" relative to each other, and a part 16, in which the edges of the slit are parallel relative to each other. Part 15 of the slit corresponds to the crown of the disc 11, which will form the raised side wall 3, while part 16 corresponds to the crown of the disc 11 which will form the outer raised rim 4. The central part 12 of the disc 11 corresponds to the bottom 2 of the dish 1.

More generally, it can be stated that, within the scope of the present invention, the central part 12 of the disc 11 corresponds to the central bottom of the dish-shaped article of revolution with circular external outlines, and that the portions 13, separated from each other by radial slits 14, correspond to the parts which are subjected to deformation relative to the said central part when embossed. Insofar as the radial slits are concerned, it can be said that, preferably, these slits incorporate zones with edges which "recede" from each other and zones with substantially parallel edges. The zones with edges which "recede" correspond to circular crowns which are to form the components of the dish which are inclined relative to the central bottom of the said dish, while the zones with substantially parallel edges correspond to circular crowns which are to form components substantially parallel to the said central bottom.

Thus, FIGS. 4 and 4*a* show a dish 21 comprising a flat circular bottom 22, a side circular wall 23, and a circular raised rim 24 parallel to the bottom 22 ending in a side wall 25 raised in the direction away from the bottom 22.

Similarly, FIGS. 5 and 5*a* show a dish 31 comprising a flat circular bottom 32, a circular side wall 33, and a circular raised rim 34 parallel to the bottom 32 ending in a side wall 35 turned down towards the bottom 32.

These two dishes can be produced by embossing the disc 41 of combustible paper containing nitrocellulose, shown in FIG. 6. This disc consists of a central part 42 and of peripheral portions 43 separated from each other by radial slits 44 comprising three separate zones numbered 44*a*, 44*b* and 44*c* from the interior of the disc towards its periphery. Zone 44*a* with receding edges forming a "V"-shaped cutout corresponds to the circular crown of the disc 41 forming, after embossing, the side wall 23 or 33 of the dish 21 or 31. Zone 44*b* with substantially parallel edges corresponds to the circular crown of the disc 41 forming, after embossing, the circular rim 24 or 34 of the dish 21 or 31. Zone 44*c* with flared "receding" edges corresponds to the circular crown of the disc 41 forming, after embossing, the raised side wall 25 of the dish 21 or the folded-down side wall 35 of the dish 31.

The number of slits which are provided on the combustible paper disc is not critical. However, two considerations restrict the lower value and the upper value of this number. An excessively small number of slits demands large peripheral portions in which, when they are deformed by embossing, there is a risk that zones of paper folds and superposition will appear, which will correspond to zones of incorrect combustion in the final article. On the other hand, an excessively high number of slits can pose problems of cutting out which are connected with the disc being excessively fragile. The number of slits is therefore a function of the diameter and of the profile of the article to be produced. For articles intended to form closure components for conventional artillery ammunition a number of slits between 6 and 16 is generally reasonable. The solution which is preferred by the Applicant Company in this field is that shown in the figures, which consists in having 12 slits in diametrically opposed pairs on six diameters forming an angle of 30° between each other.

According to the preferred embodiment of the invention, the combustible article is produced by embossing several discs of combustible paper containing nitrocellulose, of substantially the same diameter, superposed one above another so that, before embossing, the radial slits of each disc are not superposed one above another but are, on the contrary, as sets, offset relative to the others.

According to a preferred alternative form of the invention, the slits of the disc forming the outer layer of the combustible article have, at each point, a width "e" equal to the said minimum width as defined above, while the slits of other discs forming the inner layers of the said article have, at each point, a width "e" which is slightly greater than the said minimum width.

FIG. 7 shows, without regard for the proportions insofar as the thickness of the discs is concerned, a half-section along AA, of an article 21 formed in accordance with this preferred embodiment of the invention. The article consists of six discs 511, 512, 513, 514, 515 and 516, deformed by embossing. When the disc 511, forming the outer layer of the article is considered, it can be seen that the portions 531 of this disc are contiguous after embossing, the width of the slits making two portions 531 before embossing having been fixed at the minimum value to avoid the overlapping of the said portions 531 after deformation. On the other hand, if the disc 513 forming one of the inner layers of the article is considered, it can be seen that the portions 533 of this disc are non-contiguous after embossing and permit residual slits 543 to exist between them, this being due to the fact that the width of the slits 543 separating two portions 533 before embossing was fixed at a value greater than the minimal value required to prevent the overlapping of the said portions 533 after deformation. It can also be seen in this figure that the residual slits 543 of the disc 513 are offset relative to the residual slits 542 and 544 of the discs 512 and 514.

A structure such as this enables the combustible article produced by embossing to be endowed with good combustion properties in the zones which are deformed by embossing, while maintaining good mechanical behaviour of the whole. To improve the combustion properties of the article it is also possible, depending on the nature of the combustible paper used, to employ discs which are perforated beforehand.

The number of combustible paper discs superposed one above another depends on the physico-chemical nature of the combustible paper employed and on the characteristics required in the finished article.

The various discs superposed one above another before embossing may advantageously be glue-coated on one of their faces. The glues used will be vinyl or acrylic glues in aqueous emulsion or "hot melt" adhesives based on ethyl and vinyl acetate (EVA), on polyolefins or on polyamides, or glues containing a solvent based on nitrocellulose.

As already stated, the discs used for the manufacture of the combustible articles according to the invention are produced by cutting out from sheets of combustible paper containing nitrocellulose. The manufacture of sheets is carried out by starting with an aqueous suspension containing nitrocellulose, fibres of organic, synthetic, plant or inorganic origin, a resin and, optionally, a stabiliser such as diphenylamine. Any industrial nitrocellulose with a nitrogen content below 13.8% may be employed as nitrocellulose, as long as the nitrogen content of the paper leaving the papermaking machine does not exceed 12%. According to a preferred embodiment of the invention, a nitrocellulose content will be used such that the nitrogen content of the paper leaving the papermaking machine is in the region of 9%. Cellulose fibres such as kraft fibres will be advantageously employed as fibres of organic origin, but the other natural or regenerated cellulose fibres can also be suitable, including mechanical or semichemical pulp fibres or viscose fibres. Polyester fibres or acrylic fibres will be advantageously used as fibres of synthetic origin. Sisal fibres will be advantageously used as fibres of plant origin and glass fibres will be advantageously used as fibres of inorganic origin.

The presence of a resin is essential to improve the cohesion of the fibres with each other and the stability of the paper sheet. Any organic resin which has the property of flocculating on nitrocellulose or cellulose fibres and which withstands passage through a papermaking machine can be employed. The preferred resins are acrylic resins, vinyl resins, butadiene-based latices, such as butadiene-styrene or butadiene-acrylonitrile latices. It has been found that it is necessary for the weight quantity of resin to represent at least 2% of the weight quantity of nitrocellulose and of the fibres employed, and that it should preferably be in the region of 5%. The weight proportions of nitrocellulose relative to the other fibres can vary between 80:10 and 10:80, and preferably between 70:20 and 20:70. As regards the concentration of solids in the aqueous suspension, this depends essentially on the papermaking machine employed, the standard conditions of use recommended by the manufacturers and the specifications of the required product.

On leaving the papermaking machine, the sheet produced may be calendered hot or cold, or not be calendered. According to a preferred embodiment of the invention, at least the sheets from which will be cut out the discs intended to form the outer layer of the article will be calendered.

The embossing, as such, of the discs of combustible paper containing nitrocellulose, such as described above, is carried out with the aid of tools of a conventional design where embossing is concerned, consisting substantially of a metal plunger pressing the combustible paper disc or discs against a mould with the shapes of the required article. According to a preferred embodiment of the invention, embossing of the combustible paper discs is carried out hot, which enables the resin present in the combustible paper to be "cured" thus fixing in a definitive manner the shape of the combustible article produced while also permitting, in the case of combustible articles produced from several discs of combustible paper, better adhesion of the various discs to each other by virtue of a partial gelling of the various constituents of the combustible paper, which produces a virtual "welding" of the discs to each other. It is this last phenomenon which explains why the presence of glue between the various discs is preferred but is not compulsory within the scope of the present invention.

According to a preferred embodiment of the invention, the embossing temperature is in the region of 100° C. and the duration of the embossing operation, particularly when the latter is carried out hot, is in the region of one minute.

The invention also relates, as new industrial products, to combustible dish-shaped articles of revolution with circular external outlines, characterised in that they consist of at least one sheet of combustible paper containing nitrocellulose.

The invention is particularly concerned with those of the articles which are produced by virtue of the process according to the invention.

These articles, whose chief characteristic is of being perfectly combustible in a weapon, find their essential applications as components for combustible cases, and particularly as lids, as bottoms and as combustible containers. However, these articles may find an application in any field requiring circular combustible articles of revolution. Thus, they may also form relay components for a mortar or for pyrotechnic chains.

Depending on their ultimate destination, these articles may be covered with protective varnishes intended to protect them from heat or moisture, for example.

EXAMPLE

A combustible lid similar to that shown in FIG. 5 was manufactured.

This lid was produced by embossing at 100° C. for one minute at 25 bars 6 combustible paper discs similar to the disc shown in FIG. 6, coated with an acrylic glue on one of their faces. The combustible paper was prepared by passing through a papermaking machine an aqueous suspension having the following composition by weight, expressed relative to all the additives added to the water:

| Mixture A | |
|---|---|
| refined nitrocellulose (nitrogen content) 13.2%) | = 68% by weight |
| kraft (cellulose fibres) | = 26% by weight |
| acrylic resin (methyl and ethyl polyacrylate) | = 5% by weight |
| diphenylamine (stabilizer) | = 1% by weight |
| flocculating agent (alumina sulphate) | = 2% by weight of mixture A. |

After flocculation and maturing for 12 hours, the pulp was placed in a chest and its concentration was taken to 25 g/liter. The pulp was homogenized for 2 hours. The pulp was then passed through a papermaking machine. The sheets leaving the papermaking machine were calendered by passing between two rolls heated to 65° C., the unwinding speed being 12 meters/-minute. The combustible paper thus produced has a nitrogen content of 9% and a density of 1.15 g/cm$^3$.

From these sheets discs were cut out having the following geometrical characteristics:

(1) Disc forming the outer layer

Disc radius R: 95 mm

Number of slits 44: 12 slits diametrically opposed in pairs on six diameters forming an angle of 30° between them.

Slit dimensions:

length L: 32.75 mm zone 44*a*

(length: 17.25 mm (maximum width: 6.5 mm zone 44*b*

(length: 5.50 mm (width: 6.5 mm zone 44*c*

(length: 10 mm (maximum width: 12 mm (2) Discs forming the inner layers:

Disc radius R: 95 mm

Number of slits 44: 12 slits diametrically opposed in pairs on six diameters forming an angle of 30° between them.

Slit dimensions:

length L: 34.5 mm zone 44*a*

(length: 17.25 mm (maximum width: 6.5 mm zone 44*b*

(length: 5.25 mm (maximum width: 6.5 mm zone 44*c*

(length: 12 mm (maximum width: 12.5 mm.

The various discs were superposed so that the slits in each disc should be offset relative to the slits in other discs.

The final dimensions of the lid were as follows:

| | |
|---|---|
| diameter of the bottom 32 | 124 mm |
| height of the wall 33 | 18.5 mm |
| width of the rim 34 | 7 mm |
| height of the wall folded down 35 | 11 mm. |

This lid is suitable as a closure component for a component of a combustible case for a 155 mm artillery gun.

We claim:

1. Process for the manufacture of combustible dish-shaped articles of revolution with circular external outlines, components for combustible cases such as lids, bottoms or combustible containers, which consists of embossing at least one disc from combustible paper containing nitrocellulose, said disc being made by the papermaking method from an aqueous suspension containing nitrocellulose, said disc comprising a central part and a peripheral part consisting of a plurality of portions separated from each other by radial slits, the length "L" of said slits being smaller than the radius "R" of said disc and the width "e" of said slit is at least equal to the minimum width required to prevent the overlapping of the said portions when the disc is deformed by embossing.

2. Process according to claim 1, wherein the width "e" of each radial slit varies at each point along the radius on which said slit is situated.

3. Process according to claim 2, wherein said slits are closed near the central part of each disc by a "V"-shaped cutout.

4. Process according to claim 3, wherein said slits have flared edges.

5. Process according to claim 4, wherein a plurality of discs of combustible paper are embossed and the slits in the disc forming the outer layer of the combustible article have, at each point, a width "e" equal to said minimum width and the slits in the other discs forming the inner layers of said article, have at each point, a width "e" greater than the said minimum width.

6. Process according to claim 5, wherein the discs of combustible paper are perforated.

7. Process according to claim 1, wherein the combustible paper consists essentially of a mixture of nitrocellulose, resin and fibres of organic, synthetic, plant or inorganic origin and said nitrocellulose has such a nitrogen content that the combustible paper leaving the papermaking machine has nitrogen content of about 9%.

8. The process according to claim 1 which consists of hot embossing.

* * * * *